US006902496B2

(12) United States Patent
Solheim et al.

(10) Patent No.: US 6,902,496 B2
(45) Date of Patent: Jun. 7, 2005

(54) METHODS AND APPARATUS FOR A PUTTER CLUB HEAD WITH HIGH-DENSITY INSERTS

(75) Inventors: John A. Solheim, Phoenix, AZ (US); Bradley D. Schweigert, Glendale, AZ (US); Eric V. Cole, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 91 days.

(21) Appl. No.: 10/251,279

(22) Filed: Sep. 20, 2002

(65) Prior Publication Data

US 2004/0058744 A1 Mar. 25, 2004

(51) Int. Cl.[7] ..... A63B 53/04; A63B 53/06
(52) U.S. Cl. ..... 473/341; 473/349
(58) Field of Search ..... 473/324–350

(56) References Cited

U.S. PATENT DOCUMENTS 4,693,478 A * 9/1987 Long ..... 473/251
5,246,227 A 9/1993 Sun
5,322,285 A 6/1994 Turner
5,643,103 A * 7/1997 Aizawa ..... 473/290
5,669,825 A 9/1997 Shira
5,833,551 A 11/1998 Vincent
5,951,412 A * 9/1999 Rose et al. ..... 473/340
6,277,033 B1 8/2001 Krumme
6,375,583 B1 4/2002 Solheim

FOREIGN PATENT DOCUMENTS

JP 07222830 A * 8/1995 ..... A63B/53/04

OTHER PUBLICATIONS

Callister, Jr. William, Materials Science and Engineering: An Introduction, 4th Edition. New York: John Wiley & Sons, Inc., copyright 1997, p. 777.*

* cited by examiner

*Primary Examiner*—Gregory Vidovich
*Assistant Examiner*—Alvin A. Hunter, Jr.
(74) *Attorney, Agent, or Firm*—Darrell F. Marquette

(57) ABSTRACT

A putter golf club head includes a body fitted with relatively high-density heel and toe inserts. A golf putter club head includes a body formed of a first material (e.g., titanium) having a density of approximately 3.0 g/cm$^3$ to 7.0 g/cm$^3$. Two cavities are formed in the body, one adjacent to the heel region of the body, and another adjacent to the toe region. Inserts are provided in each of the two cavities and are formed of a second material (e.g., tungsten) having a density ranging from approximately 15.0 g/cm$^3$ to 20.0 g/cm$^3$. The cavities may be configured such that they extend to (or are bounded by) the bottom surface and/or the front face of the body. In one embodiment, the body of the putter club head has an elastic modulus greater than approximately 90 GPa while the density of the insert material is greater than the density of the body material by a factor of at least 3.0.

29 Claims, 6 Drawing Sheets

METHODS AND APPARATUS FOR A PUTTER CLUB HEAD WITH HIGH-DENSITY INSERTS

BACKGROUND OF THE INVENTION

1. Technical Field

This invention relates, generally, to golf clubs and, in particular, to a putter golf club head having high-density heel and toe inserts.

2. Background Information

A golfer's putting stroke is highly individualized, depending not only on the mechanical properties of the golf club, but also upon complex subjective and psychological factors. Thus, a putter club head may be designed to prioritize one particular mechanical characteristic of the club head over other competing and equally important characteristics of the club.

For example, it is often desirable to incorporate heel and toe weighting into a club head body to increase the moment of inertia of the club. This increased moment of inertia tends to decrease club head twisting in the event the golfer strikes the golf ball off-center. In an effort to increase the moment of inertia, prior art club heads generally utilize a low-density material (such as aluminum) for the club head body in conjunction with a higher density material for the heel and toe weights.

For example, U.S. Pat. No. 4,508,350 discloses a golf club putter having a high polar moment of inertia provided by forming the club head body out of aluminum. Similarly, U.S. Pat. No. 4,915,385 discloses metallic (e.g., copper) heel and toe weights used in conjunction with a lower-density (e.g., aluminum) club head.

While the use of low-density materials for the club head body may help to increase the club head's moment of inertia, such materials exhibit undesirable mechanical properties for some golfers. For example, many golfer's prefer a hard, highly-responsive solid metal surface and the attendant "hard" sound and feel when striking a golf ball. Low-density materials such as aluminum do not typically provide this type of response.

BRIEF SUMMARY OF THE INVENTION

The present invention provides a putter club head having a body fitted with heel and toe inserts having a density greater than that of the golf club body. The respective materials for the body and inserts are selected to provide a high moment of inertia while at the same time providing a desirable dynamic response at impact. In accordance with one aspect of the present invention, for example, a golf putter club head includes a body formed of a first material (e.g., titanium) having a density of approximately 3.0 g/cm$^3$ to 7.0 g/cm$^3$. Two cavities are formed in the body, one in or adjacent to the heel region of the body, and another in or adjacent to the toe region. Inserts are provided in each of the two cavities and are formed of a second material (e.g, tungsten) having a density ranging from approximately 15.0 g/cm$^3$ to 20.0 g/cm$^3$.

In accordance with another aspect of the present invention, the first and second inserts may be configured such that they comprise a portion of the bottom surface and/or the front face of the club head. In accordance with a further aspect of the present invention, the front face of the body may be machined (e.g., milled) such that the inserts are substantially flush with the front face.

In accordance with yet another aspect of the present invention, the body of the putter club head has an elastic modulus greater than approximately 90 GPa while the density of the insert material is greater than the density of the body material by a factor of at least 3.0.

BRIEF DESCRIPTION OF THE DRAWINGS

The subject invention will hereinafter be described in conjunction with the appended drawing figures, wherein like numerals denote like elements, and.

DETAILED DESCRIPTION

The present invention provides a golf putter club head having heel and toe inserts formed from a material having a density greater than that of the club head body material and falling within a specified range of values. In accordance with one aspect of the present invention, materials are selected to balance the need for a high density ratio (i.e., the ratio of insert material density and body material density) with the need for a body material that provides a suitable dynamic response, characterized, for example, by modulus of elasticity, hardness, and/or any other such property or properties.

Figure 1:
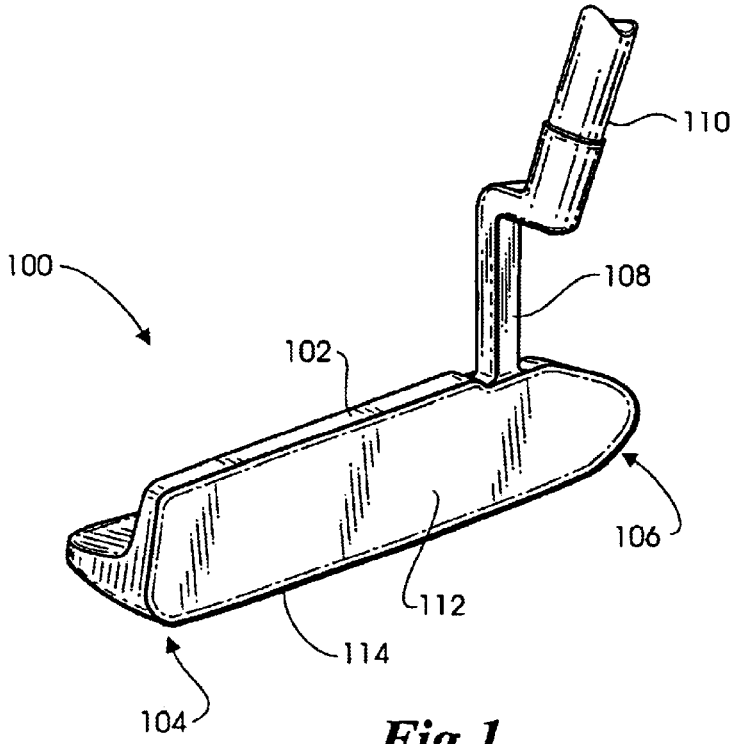
FIG. 1 is an isometric overview of a golf putter club head in accordance with one embodiment of the present invention.

With reference to FIG. 1, an exemplary golf putter club head 100 in accordance with one embodiment of the present invention includes a body 102 having a front face 112, a bottom surface or "sole" 114, a heel region 106, and a toe region 104. Body 102 is typically attached to a shaft 110 via a suitable hosel 108. Body 102 of club head 100 is formed such that it includes two cavities (not shown) configured to receive respective inserts at heel region 106 and toe region 104.

Figure 2:
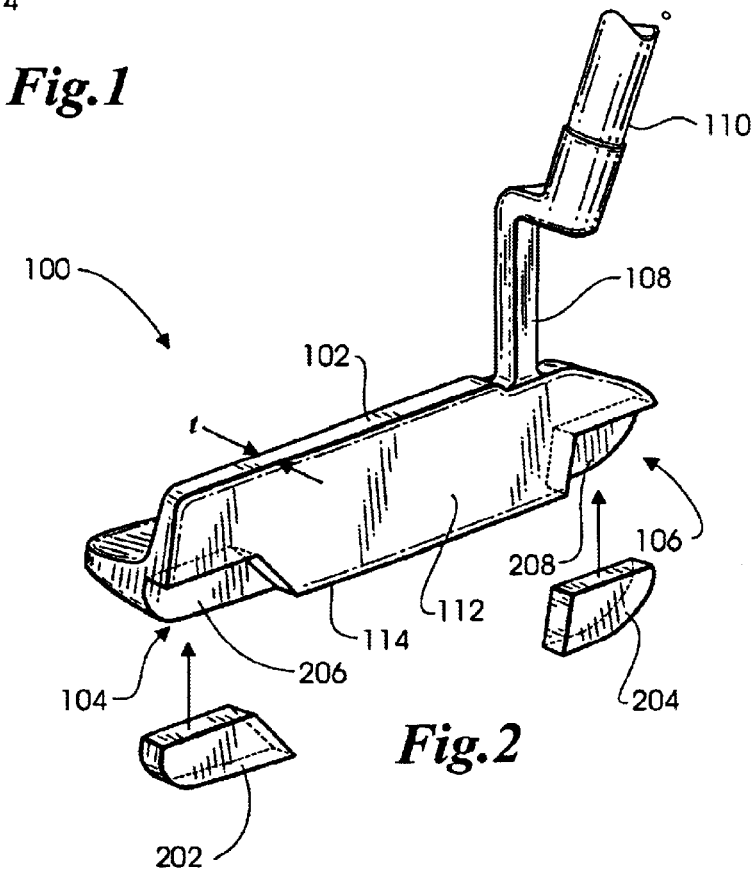
FIG. 2 is an isometric overview of a golf putter club head and associated inserts.
Figure 3:
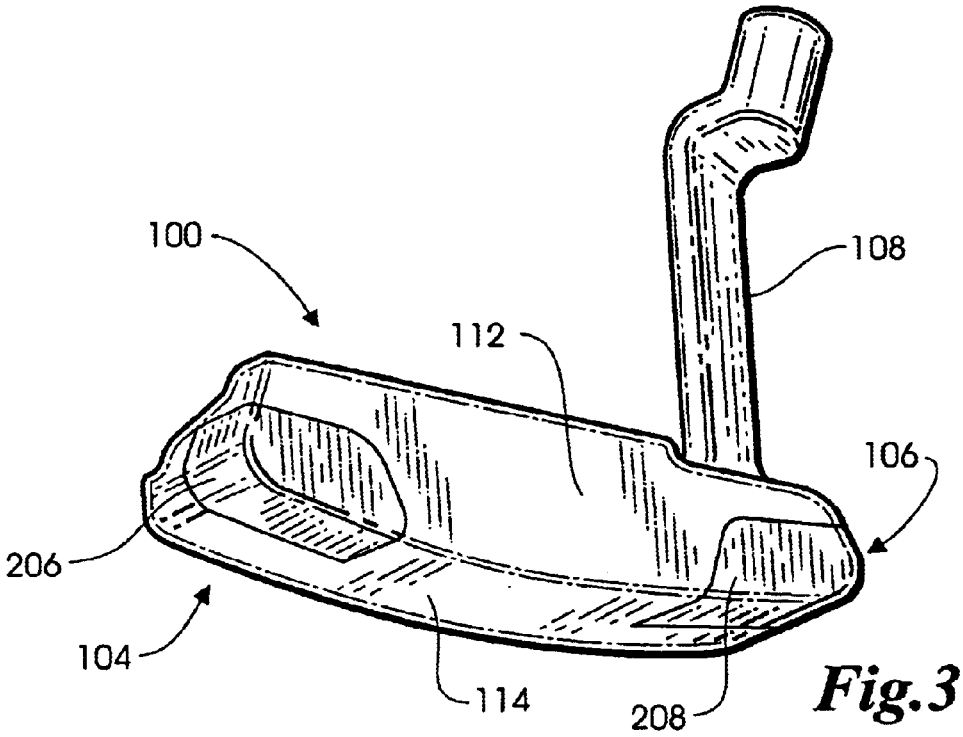
FIG. 3 is an isometric overview of a golf putter club head in accordance with one embodiment of the present invention.
Figure 4:
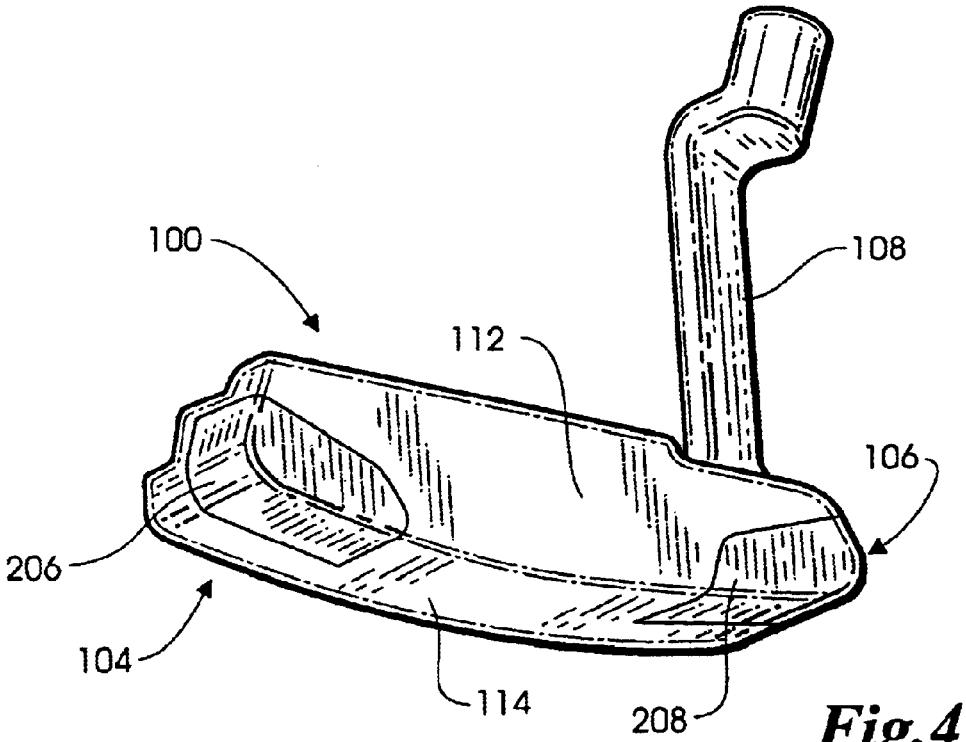
FIG. 4 is an isometric overview of a golf putter club head in accordance with an alternative embodiment of the present invention.
Figure 5:
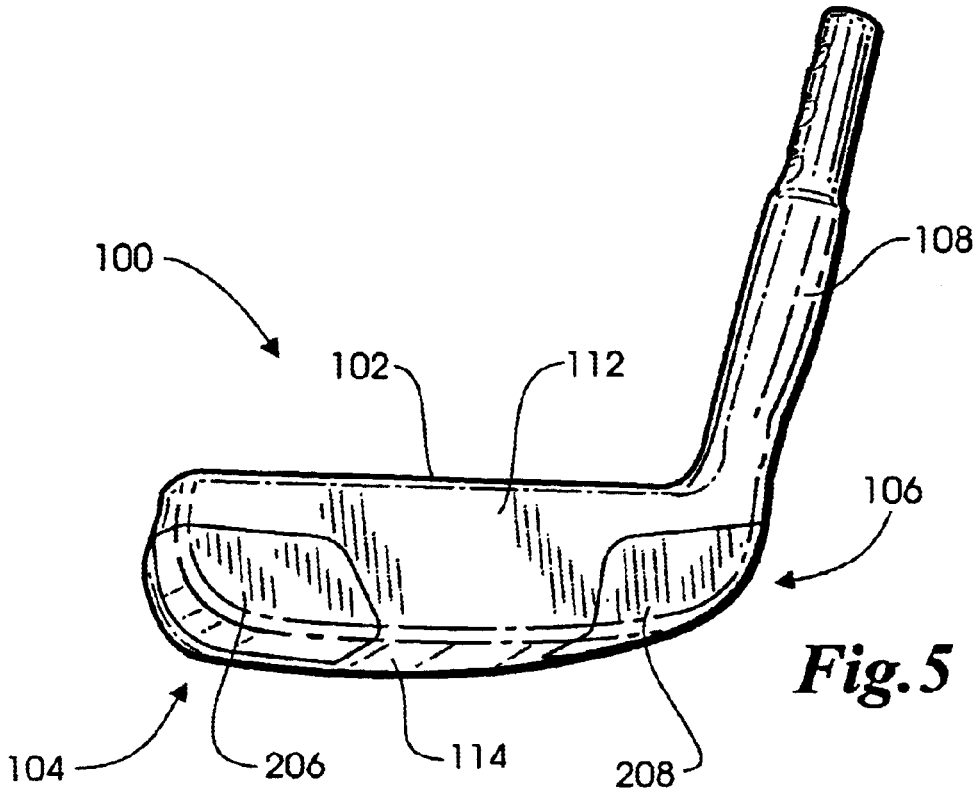
FIG. 5 is an isometric overview of a golf putter club head in accordance with a further embodiment of the present invention.
Figure 6:
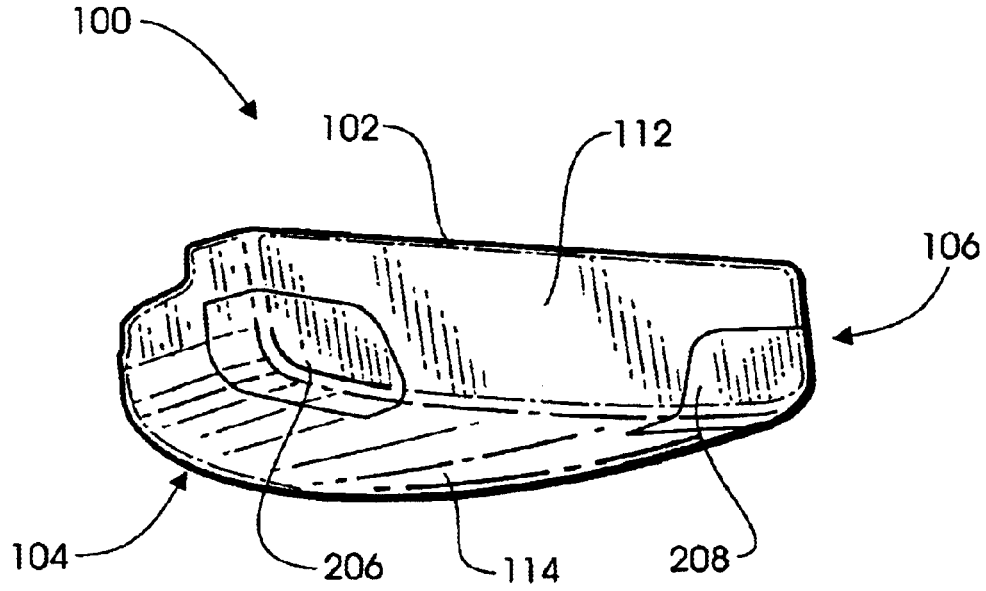
FIG. 6 is an isometric overview of a golf putter club head in accordance with yet another embodiment of the present invention.

More particularly, referring to FIG. 2, body 102 includes two cavities, "cut-outs", slots, holes, or other such wholly or partially bounded volumes 206 and 208 located in, near, or adjacent to toe region 104 and heel region 106 respectively. Inserts 202 and 204 are configured to be received within, attached to, or otherwise integrated with body 102 such that they substantially fill respective cavities 206 and 208.

Body 102 comprises any suitable metal, plastic, composite material, or combination thereof selected in accordance with various criteria as described in further detail below. In accordance with one embodiment, for example, body 102 comprises a material having a density of approximately 3.0 g/cm$^3$ to 7.0 g/cm$^3$, such as titanium or a high-purity titanium alloy. More particularly, body 102 suitably comprises a material which includes as its primary constituent a metal having an elemental density greater than a predetermined value, e.g., approximately 4.0 g/cm$^3$.

The term "primary constituent" as used herein refers to the particular element or material comprising the highest percentage of the total mass of body 102. For example, body 102 may be formed from commercial pure grade 2 titanium, which includes up to about 0.25% oxygen, 0.03% nitrogen, 0.08% carbon, 0.015% hydrogen, 0.3% iron, and 0.4% residual elements. In another example embodiment, body 102 is formed using titanium alloyed with approximately 3.0% aluminum and 2.5% cadmium In both cases, titanium is the primary constituent. The term "elemental density" refers to the density of the unalloyed or "pure" element. For example, the elemental density of titanium is approximately 4.5 g/cm$^3$, while the elemental density of aluminum is approximately 2.7 g/cm$^3$.

While the embodiments described above include a body 102 fabricated from a metallic material, the present invention is not so limited. For example, the primary constituent of body 102 might include a composite or plastic material having the desired characteristics.

Depending upon the selected material or materials, body 102 may be fabricated using any suitable process now known or later developed, including a variety of conventional casting methods such as investment-casting, powdered-metal processing, and/or metal machining. In one embodiment, body 102 is formed via a suitable casting process and thereafter milled to finish the various exposed surfaces. In this regard, conventional investment casting techniques are well known to those skilled in the art and will not be described in detail herein. For more information regarding such processes, see, e.g., SOPCAK, HANDBOOK OF LOST WAX OR INVESTMENT CASTING(1986), which is hereby incorporated by reference.

Body 102 is defined by any suitable club head shape depending upon any number of factors, including, for example, club head type (putter, wood, etc.), desired moment of inertia (e.g., the polar moment of inertia around an axis normal to the club head sole), desired center of gravity, desired aesthetic properties (e.g., visual cues provided by the club head's contours as viewed from above during play), and/or the desired weight, mass, and density. In this regard, it will be appreciated that the exemplary club head shapes depicted in FIGS. 1–6 are for illustrative purposes only, and that the present invention is not so limited.

Body 102 has a suitable face thickness t which may vary across the length of face 112. The thickness t, particularly near the center of face 112, is selected to provide a suitable response to club head 100 striking a golf ball. In one embodiment, thickness t has a value ranging from approximately 200 mils (7.9 microns) to approximately 500 mils (19.7 microns), preferably between 300 mils (11.8 microns) to 400 mils (15.7 microns), most preferably approximately 325 mils (12.8 microns).

Cavities 206 and 208 include suitable "cut-outs", slots, holes, or any other such defined volumes. Cavities 206 and 208 may be fashioned within body 102 such that, when inserts 202 and 204 are inserted in their respective cavities, the finished club head has a distinct visual appearance. This distinct visual appearance may be provided through the use of any combination of shapes, colors, textures, and/or the like. FIGS. 2–6 depict exemplary configurations for inserts 202 and 204 with respect to body 102. It will be appreciated, however, that the exemplary insert shapes 202 and 204 shown in FIGS. 2–6 are not intended as a limitation of possible insert geometries.

Cavities 206 and 208 may be configured with respect to body 102 such that inserts 202 and 204 comprise a portion of one or more exposed surfaces of club head 100, e.g., the top, back, bottom, front, and/or sides of the club head. In various embodiments of the present invention, shown in FIGS. 2–6, inserts 202 and 204 comprise a portion of front face 112 and bottom surface 114. This placement assists in positioning the relatively high-density inserts toward the antipodal extremes of toe region 104 and heel region 106 (thus increasing the moment of inertia of club head 100) while at the same time keeping the weight low and close to bottom surface 114 (thus lowering the center of mass and facilitating desirable spin characteristics upon impact). In this regard, while the various embodiments shown in FIGS. 2–6 depict inserts that intersect the bottom surface 114 and front face 112 of body 102, the present invention comprehends that one or more of the inserts may be wholly or partially encapsulated by body 102 or may extend to the outer surfaces of body 102 at any number of locations.

Inserts 202 and 204 are fabricated from a material or materials having a density that is greater than that of body 102. The incorporation of relatively high-density inserts 202 and 204 in this way results in a higher moment of inertia for club head 100. The higher the moment of inertia, the less likely club head 100 will twist when it impacts a golf ball at an off-center location. In this regard, inserts 202 and 204 may be fabricated using any suitable material, including various metals, plastics, composite materials, or any combination thereof. In one embodiment, inserts 202 and 204 comprise a material such as tungsten having a density ranging from approximately 15.0 g/cm$^3$ to 20.0 g/cm$^3$. In a preferred embodiment, the density of inserts 202 and 204 is in the range of 17.0 g/cm$^3$ to 19.0 g/cm$^3$.

Inserts 202 and 204 may be configured to provide an appropriate amount of weighting to heel region 106 and toe region 104. In one embodiment, the total weight of inserts 202 and 204 is within the range of 50 grams to 100 grams. In a particular embodiment, wherein the total weight of club head 100 is approximately 315 to 380 grams (preferably about 345 grams), the total weight of inserts 202 and 204 is in the range of 75 to 105 grams, preferably about 85 to 95 grams, and most preferably approximately 90 grams. In the interest of symmetry, it is advantageous to fit club head 100 with inserts 202 and 204 having substantially the same weight. The present invention, however, also contemplates the use of inserts having different weights and/or manufactured from different materials. Such an embodiment might be advantageous, for example, to compensate for other non-symmetrical features of club head 100 and to better align the center of mass of club head 100 with the center of front face 112.

Inserts 202 and 204 may be fixed within respective cavities 206 and 208 using any suitable method now known or later developed, including the use of adhesives and/or conventional metal-joining operations such as soldering, brazing, and the like. In one embodiment, inserts 202 and 204 are attached to one or more inner surfaces of respective cavities 206 and 208 using a conventional copper brazing process. The brazing process may be accompanied by a suitable plating process as is well known in the art. In the event inserts 202 and 204 extend to one or more of the outer surfaces of body 102 (e.g., front face 112 or bottom surface 114 as shown in FIGS. 2–6), it is advantageous to mill the resulting surfaces such that inserts 202 and 204 are substantially flush with body 102.

Figure 9:
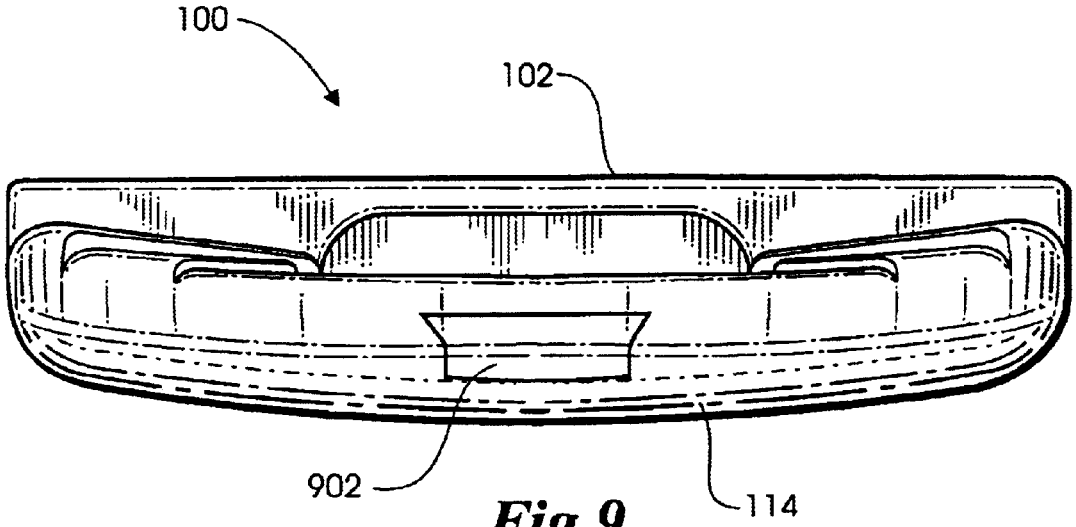
FIGS. 9 and 10 are rear views of various golf putter club heads in accordance with yet another aspect of the present invention.
Figure 10:
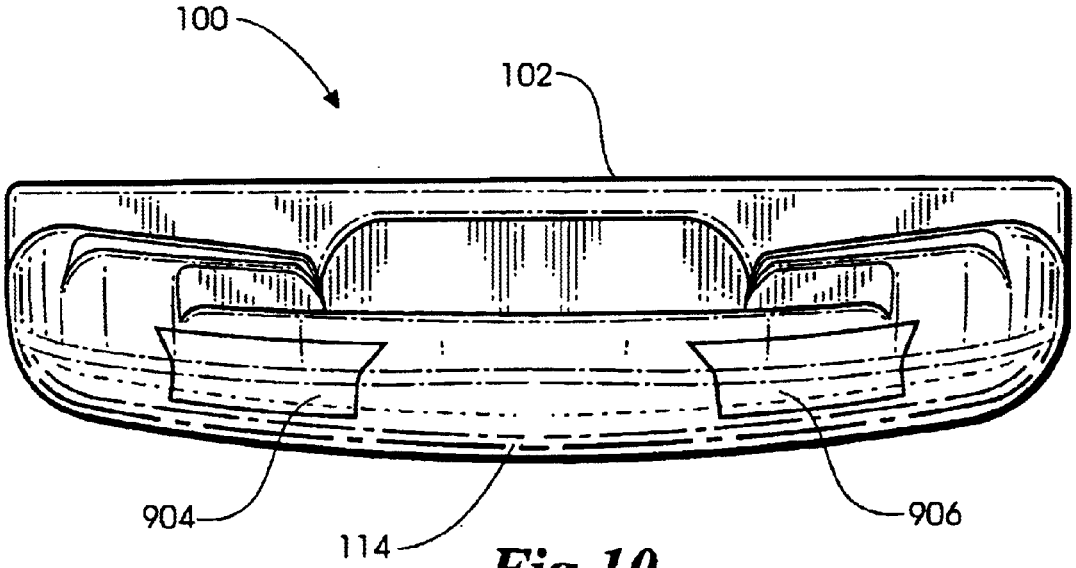

In accordance with another aspect of the present invention, one or more inserts may be integrated toward the back of the club head, i.e., along the edges and/or back surfaces of the club head. Such an embodiment may be particularly advantageous in "mallet-shaped" club heads. The use of additional inserts in this way assists in increasing the polar moment of inertia of the club head. At the same time, the center of gravity for the club head may be lowered by using lower profile inserts. That is, for a given total insert weight, the use of more, lower-profile inserts results in a lower center of gravity. FIG. 9, for example, shows a single weight 902 (for example, a tungsten weight as described above) centered opposite front face 112. FIG. 10 shows the use of a pair of weights 904 and 906 secured within the back of the club head at generally heel and toe locations. As with inserts 206 and 208, inserts 902, 904, and/or 906 may be shaped and positioned within body 102 such that they form a portion of any of the various exposed surfaces of the club head. Alternatively, inserts 902, 904, and/or 906 may be entirely or substantially encapsulated by body 102.

Figure 7:
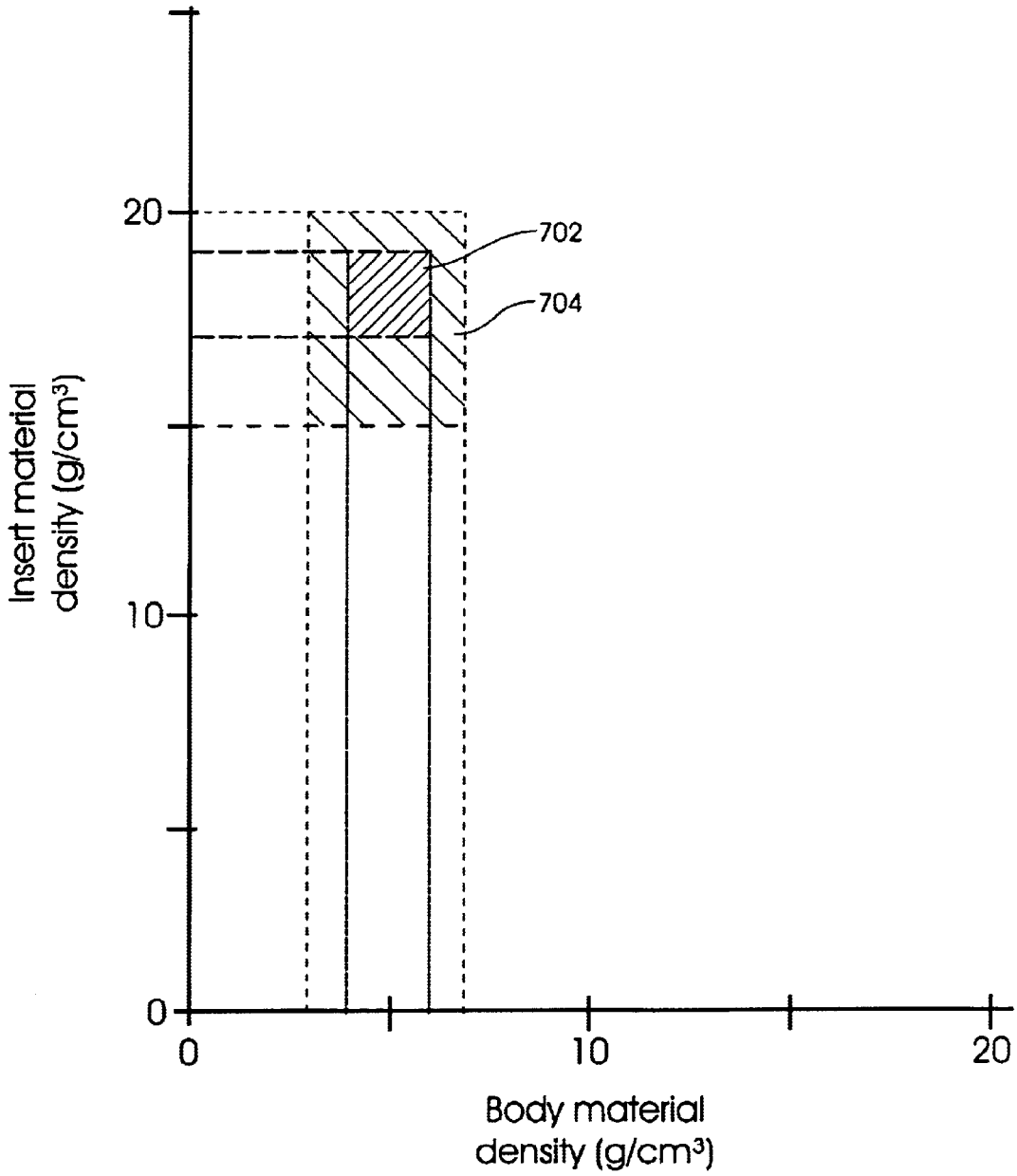
FIG. 7 is a graph showing the quantitative relationship between body and insert density in accordance with various embodiments of the present invention.

As mentioned above, the materials for body 102 and inserts 202 and 204 are preferably selected such that the density of the material used for inserts 202 and 204 is substantially greater than that used for body 102. In this regard, FIG. 7 shows a graphical representation of exemplary density ranges for insert and body materials. One rectangular design region 704 is defined by a body material density ranging from approximately 3.0 g/cm$^3$ to 7.0 g/cm$^3$ and an insert material density ranging from 15.0 g/cm$^3$ to 20.0 g/cm$^3$. A second design region 702 is defined by a body material density ranging from approximately 40 g/cm$^3$ to 60 g/cm$^3$, and an insert material density ranging from approximately 17.0 g/cm$^3$ to 19.0 g/cm$^3$.

In a particular embodiment lying close to the center of design region 702, a high-purity titanium is used for the body material (e.g., a grade 2 commercial purity titanium having a density of approximately 4.5 g/cm$^3$), and a high-purity tungsten is used for the insert material (e.g., a powdered-metal pressed tungsten having a density of approximately 18.0 g/cm$^3$).

In accordance with another embodiment of the present invention, the various materials for the body and inserts are selected to maximize the club head's moment of inertia and, at the same time, to provide a desirable response at impact. While the moment of inertia of club head 100 may be increased to a very high value by utilizing a body material having a very low density (e.g., aluminum, or any number of polymeric compounds), such a low density material may exhibit other mechanical properties that result in undesirable dynamics when front face 112 of club head 100 strikes a golf ball.

Various mechanical properties control the nature of ball impact and resultant dynamics. The modulus of elasticity of the body material, for example, affects to a large extent the efficiency of energy transfer (or "coefficient of restitution") at the moment of impact. For example, high-purity aluminum has a density of approximately 2.7 g/cm$^3$, which is lower than high-purity titanium (and significantly less expensive); however, the modulus of elasticity of high-purity aluminum is approximately 70 GPa, while the modulus of elasticity of high-purity titanium is greater than 90 GPa, and generally ranges from 110 GPa to 115 GPa. Thus, it is desirable in many instances to utilize body and insert materials which balance the need for a high density ratio (i.e., the ratio of insert material density and body material density) with the need for a body material which provides a suitable dynamic response (characterized, for example, by modulus of elasticity, hardness, and/or any other such property).

Figure 8:
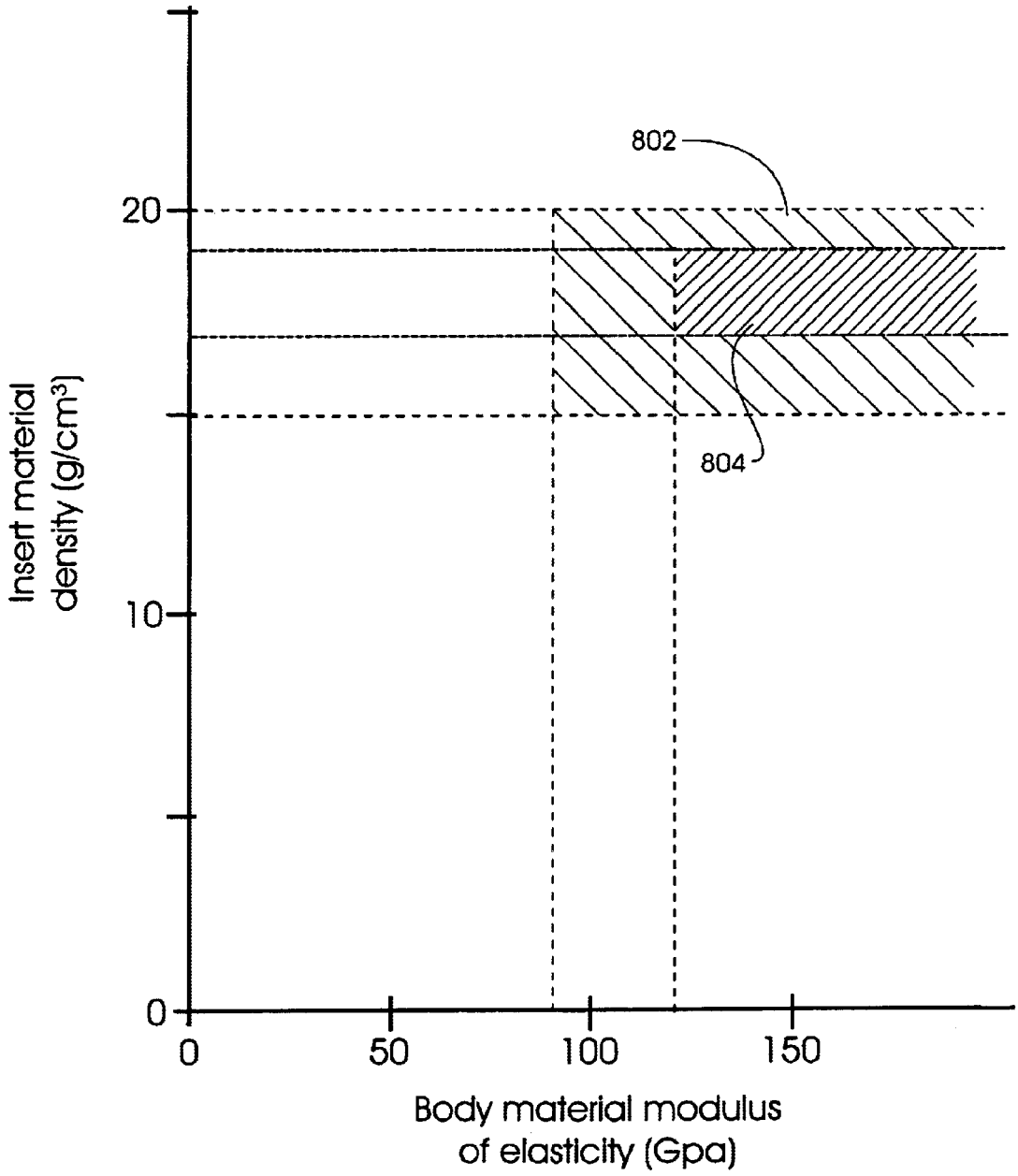
FIG. 8 is a graph showing the quantitative relationship between elastic modulus and insert density in accordance with various embodiments of the present invention.

Toward this end, FIG. 8 depicts various design regions in accordance with a further aspect of the present invention wherein the material densities are selected to achieve a particular insert material density while at the same time utilizing a body material having an advantageously high modulus of elasticity. Design region 802 is defined by an elastic modulus greater than or equal to 90 GPa and an insert material density ranging from approximately 15.0 g/cm$^3$ to 20.0 g/cm$^3$. Design region 804 is defined by an elastic modulus greater than or equal to 110.0 GPa and an insert material density ranging from approximately 17.0 g/cm$^3$ to 19.0 g/cm$^3$.

Again, while the embodiments described above include a body 102 fabricated from a metallic material, the primary constituent of body 102 might include a composite or plastic material having a density and/or modulus of elasticity within the desired range.

In conclusion, what has been provided is a putter golf club head having a relatively low-density body (e.g., a titanium body) fitted with relatively high-density heel and toe inserts (e.g., tungsten inserts). Although the invention has been described herein in conjunction with the appended drawings, those skilled in the art will appreciate that the scope of the invention is not so limited. For example, while the present invention has been described in terms of golf putters, many other types of golf clubs would profit from the present invention, including irons, metal woods, etc. Moreover, while titanium and tungsten have been cited as preferred materials for the body and inserts respectively, it will be appreciated that any suitable material now known or later developed may be used in connection with the present invention, including various metals, alloys, composites, ceramics, and the like. These and other modifications in the selection, design, and arrangement of the various components and steps discussed herein may be made without departing from the scope of the invention as set forth in the appended claims.

What is claimed is:

1. A golf putter club head of the type having a bottom surface, a front face, a heel and a toe, said club head comprising:

a body formed of a first material having a first density;

said body having a first cavity formed in said heel region and a second cavity formed in said toe region, wherein said first cavity inntersects said bottom surface and said front face, and wherein said second cavity intersects said bottom surface and said front face;

a first insert provided in said first cavity and a second insert provided in said second cavity, said first and second inserts formed of a second material having a second density;

said first density having a value in the range of approximately 3.0 g/cm$^3$ to 7.0 g/cm$^3$, wherein said first material has a primary constituent having an elemental density greater than approxmately 4.0 g/cm$^3$;

said second density having a value in the range of approximately 15.0 g/cm$^3$ to 20.0 g/cm$^3$.

2. The golf putter club head of claim 1, wherein the primary constituent of said first material comprises titanium.

3. The golf puller club head of claim 1, wherein the primary constituent of said second material comprises tungsten.

4. The golf putter club head of claim 1, wherein said first density is in the range or approximately 4.0 g/cm$^3$ to 6.0 g/cm$^3$ and said second density is in the range ot approximately 17.0 g/cm$^3$ to 19.0 g/cm$^3$.

5. The golf putter club head of claim 1, wherein said first and second inserts have substantially the same mass.

6. The golf putter club head of claim 1, wherein said body further includes a bottom surface, and wherein said first and second inserts comprise a portion of said bottom surface.

7. A golf putter club head of the type having a bottom surface, a front face, a heel region and a toe region, said club head comprising:

a body formed of a lust material having an elastic modulus and a first density, said body having a first cavity formed in said heel region and a second cavity formed in said toe region, wherein said first cavity intersects said bottom surface and said front face, and wherein said second cavity intersects said bottom surface and said front face;

a first insert provided in said first cavity and a second insert provided in said second cavity, said first and second inserts formed of a second material having a second density;

said elastic modulus of said first material being greater than approximately 90 GPa;

said second density being greater than said first density by a factor of at least 3.0.

8. The golf putter club head of claim 7, wherein said first material comprises titanium.

9. The gulf putter club head of claim 7, wherein said second material comprises tungsten.

10. The gulf putter club of claim 7, wherein said first density is in the range of approximately 4.0 g/cm$^3$ to 6.0 g/cm$^3$, and said second density is in the range of approximately 17.0 g/cm$^3$ to 19.0 g/cm$^3$.

11. The golf putter club head of claim 7, wherein said elastic modulus of said second material is greater than approximately 110 GPa.

12. The golf putter club head claim 7, wherein said first and second inserts have substantially the same mass.

13. The golf putter club head of claim 7, wherein said body further includes a bottom surface, and wherein said first and second inserts comprise a portion of said bottom surface.

14. A method of fabricating a golf putter club head, said method comprising the steps of:

(a) forming a body from a first material having a first density of approximately 3.0 g/cm$^3$ to 7.0 g/cm$^3$, wherein said first material includes as its primary constituent a metal having an elemental density greater than approximately 4.0, said body having a bottom surface, a front face, a heel region, a toe region, a first cavity within said heel region, and a second cavity within said toe region, wherein said first cavity intersects said bottom surface and said front face, and wherein said second cavity intersects said bottom surface and said front face;

(b) forming a first insert and a second insert from a second material having a second density of approximately 15.0 g/cm$^3$ to 20.0 g/cm$^3$;

(c) affixing said first insert within said first cavity; and (d) affixing said second insert within said second cavity.

15. The method of claim 14, wherein said step (a) includes forming said body from titanium.

16. The method of claim 14, wherein said step (b) includes forming said first and second inserts from tungsten.

17. The method of claim 14, wherein said first density is in the range of approximately 4.0 g/cm$^3$ to 6.0 g/cm$^3$, and said second density is in the range of approximately 17.0 g/cm$^3$ to 19.0 g/cm$^3$.

18. The method of claim 14, wherein said step (b) includes forming said first and second inserts such that said first and second inserts have substantially the same mass.

19. The method of claim 14, wherein said steps (c) and (d) includes performing a copper brazing procedure.

20. The method of claim 14, wherein said step (a) includes forming a bottom surface on said body such that said first and second cavities intersect said bottom surface.

21. The method of claim 14, wherein said step (a) includes forming a front face on said body such that said first and second cavities intersect said front face.

22. The method of claim 21, further including the stop of milling said front face such that said first and second inserts are substantially flush with said front face.

23. The method of claim 14, wherein said step (c) includes forming said first and second inserts utilizing a powder metal procedure.

24. The method of claim 14, wherein said step (a) includes forming said body utilizing a casting procedure.

25. The method of claim 24, further including the step of milling at least a portion of said body after said casting procedure.

26. A golf putter club head of the type having a heel region and a toe region, said club head comprising a titanium body, said body having a bottom surface and a front face; said body having a first cavity formed in the heel region and a second cavity formed in the toe region; a first tungsten insert provided in said first cavity and a second tungsten insert provided in said second cavity, said first and second tungsten inserts having substantially the same mass; said first and second cavities being bounded by both said bottom surface and said front face such that said first and second inserts are substantially flush with both said bottom surface and said front face.

27. The golf putter head of claim 26, wherein the mass of each of said first and second inserts is between approximately 50 grams and 100 grams.

28. The golf putter club head of claim 26, wherein said body has a body mass, and wherein said first and second inserts have a combined insert mass that is greater than or equal to approximately 40% of said body mass.

29. The putter club head of claim 26, wherein the sum of said body mass and said combined insert mass is between approximately 315 grams and 380 grams.

* * * * *